US006222163B1

(12) United States Patent
Arntz et al.

(10) Patent No.: US 6,222,163 B1
(45) Date of Patent: Apr. 24, 2001

(54) GAS OVEN INCORPORATING AUXILIARY ELECTRIC HEATING ELEMENT

(75) Inventors: Richard J. Arntz, Georgetown; Isaac P. Sargunam, Cleveland, both of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/417,217

(22) Filed: Oct. 13, 1999

(51) Int. Cl.[7] ..... H05B 1/02

(52) U.S. Cl. ..... 219/483; 219/395; 219/494; 126/39 R; 126/39 BA; 392/307; 392/310

(58) Field of Search ..... 392/307–310; 219/483–486, 395, 494, 411–413, 501, 506, 497; 126/39 R, 39 BA, 92 R

(56) References Cited

U.S. PATENT DOCUMENTS

| | | | |
|---|---|---|---|
| 1,475,608 | 11/1923 | Templeton . | |
| 1,495,685 | 5/1924 | Graf . | |
| 1,815,088 | 7/1931 | Allen et al. . | |
| 2,222,065 | 11/1940 | Blakeslee . | |
| 2,463,712 | 3/1949 | Newell . | |
| 2,908,234 | 10/1959 | Naylor . | |
| 3,423,568 | 1/1969 | Meckley, III et al. . | |
| 5,193,522 | 3/1993 | Damsteegt et al. . | |
| 5,275,147 | 1/1994 | Aktinson, III . | |
| 5,492,055 | 2/1996 | Nevin et al. . | |
| 5,909,533 * | 6/1999 | Kitabayashi et al. | 392/310 |

* cited by examiner

*Primary Examiner*—Mark Paschall
(74) *Attorney, Agent, or Firm*—Everett G. Diederiks, Jr.

(57) ABSTRACT

A gas cooking appliance includes upper and lower gas burner units, as well as an upper electric heating element, which is configured and mounted in an enhanced operational manner, within an oven cavity. A control system is provided to control the electric heating element based on the operation of at least one of the upper and lower gas burner units. For instance, during a baking mode of operation, the electric heating element is cycled on and off while the lower burner unit is in a full operating state. In a broiling mode, both the upper gas burner unit and the electric heating element are activated in order to create a substantially uniform temperature within the oven cavity. During a cleaning mode of operation, the electric heating element is used to pre-heat the oven cavity at a controlled rate prior to operation of the lower burner unit.

17 Claims, 1 Drawing Sheet

GAS OVEN INCORPORATING AUXILIARY ELECTRIC HEATING ELEMENT

BACKGROUND OF THE INVENTION

1. Field of the Invention

The present invention pertains to the art of cooking and, more particularly, to the incorporation, mounting and control of an auxiliary electric heating element within a gas oven.

2. Discussion of the Prior Art

Hybrid ovens have been proposed in the art of cooking appliances. More specifically, it has been previously proposed to provide a combination gas/electric oven wherein gas and electric heating elements can be used independently or simultaneously as heat sources for the oven. Typically, the electric heating element is utilized only for certain periods, i.e., during particular modes of operation of the appliance. For example, U.S. Pat. No. 2,463,712 discloses a hybrid cooking appliance incorporating an electric heating element which is particularly used for broiling purposes, but the electric heating unit can also be used when the oven cavity is to be heated above a predetermined temperature during a baking mode of operation. However, during the baking operation, once the oven has reached a desired temperature condition, a thermostat functions to automatically cut off the electric heating element such that the oven temperature is maintained through operation of the gas alone.

In another exemplary arrangement as disclosed in U.S. Pat. No. 3,423,568, upper and lower electric heating elements can be used by themselves or simultaneously with upper and lower gas burners to heat an oven cavity. However, the oven is primarily intended to be used with gas for normal cooking purposes, while the electric heating elements are particularly adapted for use during oven cleaning periods.

Regardless of these prior arrangements, there still exists a need in the art for a combination gas and electric cooking appliance wherein an electric heating element is effectively used during various modes of operation of the appliance. More specifically, there exists a need for a cooking appliance incorporating an electric heating element which is constructed and mounted within an oven cavity in a manner that enables the electric heating element to be efficiently utilized during baking, broiling and/or cleaning modes of operation.

SUMMARY OF THE INVENTION

The present invention is concerned with incorporating an electric eating element at a top portion of a gas oven cavity. That is, the oven cavity includes a lower gas burner unit, an upper gas burner unit and an upper, auxiliary electric heating element. The electric heating element is preferably arranged in a substantially horizontal plane at a position no closer to a top wall portion of the oven cavity than the ports associated with the upper gas burner unit in order to minimize any flame impingement upon the electric heating element. The electric heating element can be utilized during various modes of operation of the cooking appliance, such as during baking, broiling and cleaning operations.

More specifically, the most preferred form of the invention has the electric heating element operating in unison with the lower gas burner unit to pre-heat the oven cavity for a baking operation and then the electric heating element is cycled on and off while the lower gas burner unit is operated in a full state during the baking mode. During a broiling operation, the electric heating element preferably operates on full with the upper gas burner unit in order to establish a substantial uniform temperature throughout the oven cavity. During a cleaning operation, the electric heating element is preferably, initially operated to pre-heat the oven cavity at a controlled rate prior to operation of the upper and lower gas burner units. A controller is used to regulate the operation of each of the gas burner units and the electric heating element in the manner set forth above based on signals received from at least one temperature sensor and operator input controls.

Additional objects, features and advantages of the present invention will become more fully apparent below from the following detailed description of a preferred embodiment when taken in conjunction with the drawings wherein like reference numerals refer to corresponding parts in the several views.

DETAILED DESCRIPTION OF A PREFERRED EMBODIMENT

Figure 1:
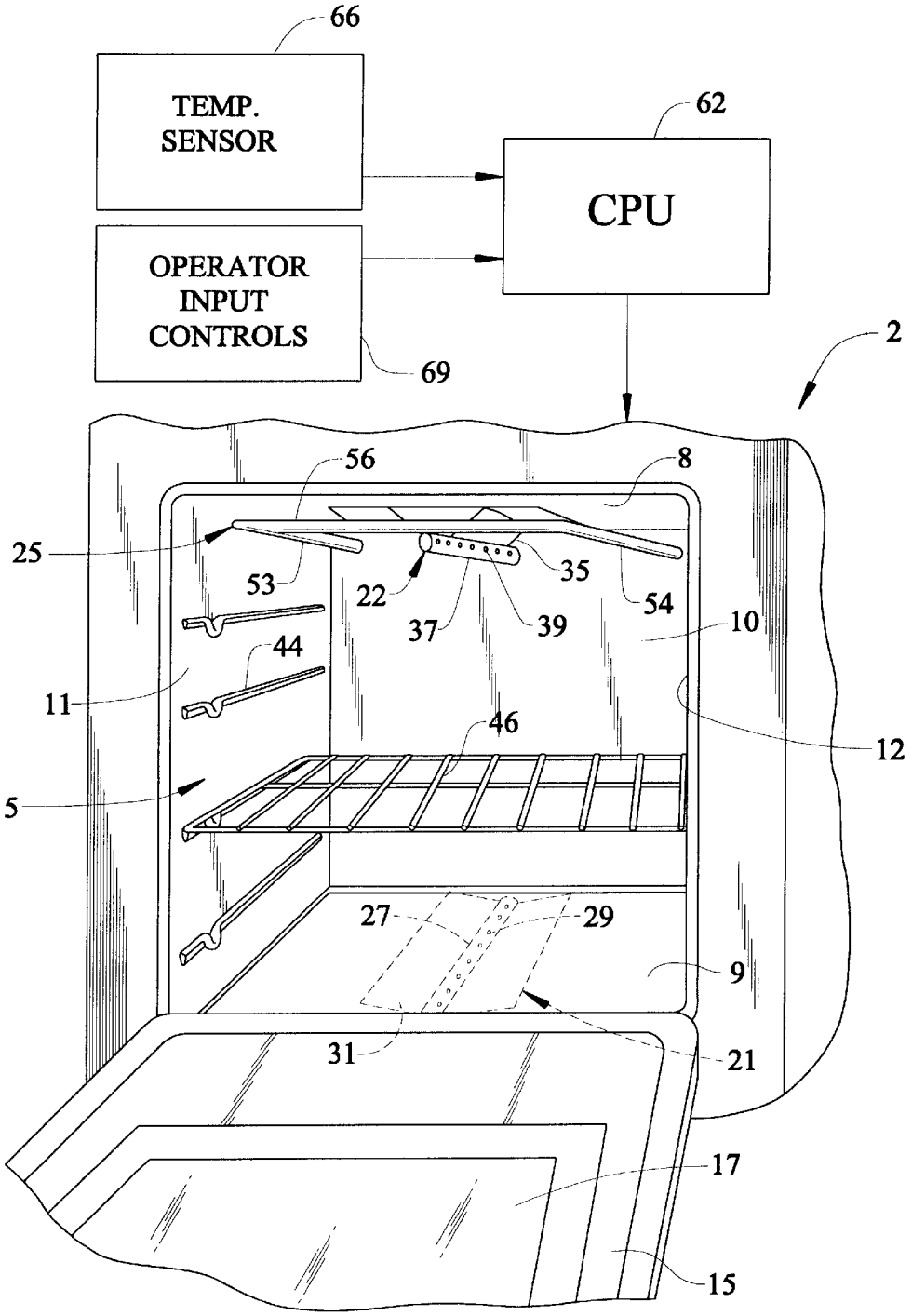
FIG. 1 is a perspective view of a gas oven incorporating an auxiliary electric heating element and a related control system in accordance with the present invention.

As shown in FIG. 1, an oven 2 includes a cavity 5 defined by top, bottom, rear and side walls 8–12 respectively. Cavity 5 is adapted to be closed by means of a door 15 that is illustrated to include tempered glass section 17. In accordance with the invention, oven 2 can constitute a portion of a range or part of an oven wall unit. In either case, to develop heat within oven cavity 5 for cooking food items placed therein, oven 2 includes a first gas burner or baking unit 21, a second gas burner or broiling unit 22 and an electric heating element 25.

More specifically, first gas burner unit 21 generally takes a form known in the art and therefore includes an elongated manifold 27 that is provided with various gas emitting ports 29. Ports 29 generally open towards a flame spreader plate 31 that extends on opposing sides of manifold 27 and which takes the form of a flattened V-shape piece. As clearly shown in this figure, first gas burner unit 21 is preferably mounted beneath bottom 9 of oven cavity 5. In a similar manner, second gas burner unit 22 includes a flame spreader 35, that generally takes a flattened V-shape, and a manifold 37 having a plurality of gas emitting ports 39. The actual construction and general operation of first and second gas burning units 21 and 22 is actually well known in the art, does not form part of the present invention and therefore will not be discussed further herein.

In a manner also known in the art, side walls 11 and 12 of oven cavity 5 are preferably provided with a plurality of fore-to-aft extending and vertically spaced runners, one of which is indicated at 44. The runners 44 are arranged in associated pairs on side walls 11 and 12 in order to support an elongated rack 46 that extends across substantially the entire width of oven cavity 5. Of course, elongated rack 46 can be supported upon any respective pair of runners 44 such that rack 46 can assume various vertical positions within cavity 5. For the sake of simplicity of the drawing, runners 44 have been shown to be vertically spaced quite a distance on each of sides 11 and 12 when actually, additional runner 44 would be provided such that the spacing would be much less than that shown. In any event, the arrangement and mounting of rack 46 within cavity 5 is not considered part of the present invention such that it will not be discussed further herein. Instead, the present invention is particularly directed to the inclusion of electric heating element 25, its particular mounting arrangement relative to second gas burner unit 22 and the manner in which electric heating element 25 is operated in conjunction with one or more of first and second gas burner units 21 and 22.

In accordance with the most preferred form of the invention, electric heating element 25 generally takes a U-shaped form, including fore-to-aft legs 53 and 54 and a connecting leg 56. Electric heating element 25 is preferably constituted by a sheathed electric resistance element similar to those typically found in a conventional electric range. Although not particularly shown in the drawing, each of legs 53 and 54 would be provided with a terminal connector that projects through rear wall 10 of oven cavity 5, with the connectors being attached to wires for activating/de-activating electric heating element 25. As shown, electric heating element 25 is mounted in a position spaced below top wall 8 of oven cavity 5. More specifically, manifold 37 of second gas burner unit 22 extends in a generally horizontal plane which is spaced below top wall 8 of oven cavity 5. Electric heating element 25 is preferably mounted within oven cavity 5 at a position no closer to top wall 8 than ports 39 of manifold 37. During operation of second gas burner unit 22, the flames extending from manifold 37 would be directed onto flame spreader 35 in order to enhance the distribution of heat generated within oven cavity 5. The mounting of electric heating element 25 relative to ports 39 in the manner described above avoids direct impingement of legs 53, 54 or 56 by the flames. Furthermore, the relative mounting of second gas burner unit 22 and electric heating element 25 has been found to minimize any affect of the heat generated by electric heating element 25 on the combustion of gas associated with second burner unit 22. As will be discussed more fully below, this mounting, as well as the configuration of electric heating element 25, balances hot and cold spots that can be generated within oven cavity 5 during operation thereof.

At this point, it should be understood that electric heating element 25 can take various shapes and can be mounted in numerous ways, such as through the use of hanging brackets which extend around portions of legs 53, 54 and 56 and are secured to top wall 8 of cavity 5. The actual wattage rating of electric heating element 25 would depend on the supplied amperage to oven 2. That is, a typical electric range would include an oven cavity having a fairly uniform size in the art, but the power hook-up can generally vary between 15 and 20 amps circuits. In a 20 amp circuit for oven 2, electric heating element 25 preferably constitutes a 1400 watt element that works on 120 volts. In a 15 amp circuit, a 1250 watt element is preferably utilized. For the lower amp circuit, a higher wattage element could be utilized. Regardless, such minor changes in the overall system is considered well within one of ordinary skill in the art. For the sake of completeness, electric heating element 25 is preferably utilized in the embodiment shown with second gas burner unit 22 which constitutes a natural gas broiler having a 14,000 BTU/hr rating.

The cooking appliance in accordance with the present invention also incorporates a controller 62 that is used to regulate the operation of each of first gas burner unit 21, second gas burner unit 22 and electric heating element 25. In general, controller 62 receives signals from a temperature sensor 66, which is arranged to sense the temperature within oven cavity 5 in a manner known in the art, as well as input signals from operator controls as generally indicated at 69. These operator controls 69 are widely known in the art and include such selections as the particular operating mode for oven 2, i.e., baking, broiling, cleaning and the like modes, a desired temperature setting for a cooking operation and, as now found on more modern ranges, a desired cooking time. Again, since these types of controls are widely known in the art and do not form part of the present invention, they have not been separately shown in the figure. Instead, operator input controls 69 are generically represented and it is to be understood that the associated selectors can take the form of knobs, buttons, etc. as is common in the art.

In addition to the particular mounting arrangement between second as burner unit 22 and electric heating element 25, the manner in which electric heating element is operated during use of oven 2 in various modes, including baking, broiling and cleaning operational modes, is an important aspect of the present invention as will now be described in full. During a baking operation in a conventional gas oven, only the first or lower gas burner unit 21 would be operated. However, in accordance with the present invention, electric heating element 25 is also activated during a baking operation to improve baking performance. In general, it would not be desirable to operate second gas burner unit 22 during a baking operation since it would have to operated intermittently and this would create certain issues related to combustion of gas and proper burner performance. In the most preferred form of the invention, controller 62 cycles electric heating element 25 on and off while operating first gas burner unit 21 at a full operating state. Most preferably, controller 62 cycles electric heating element 25 on and off at less than full capacity during the baking mode, with the off-cycle period for electric heating element 25 being multiple times greater than the on-time period. In the most preferred form of the invention, an on/off duty cycle of ten second on to 50 seconds off is utilized and has been found during testing to significantly enhance the overall cooking performance. Of course, the duty cycle ratio can be varied in accordance with the present invention, although it is desired to have a longer off-cycle period than the on-time period.

During a typical baking operation, oven cavity 5 can reach a temperature which would warrant cutting off all heat sources, or at least greatly reducing the capacity thereof. In the most preferred form of the invention, controller 62 functions to de-activate electric heating 25 when first gas burner unit 21 is cycled off or operated at lower than it full state. Furthermore, electric heating element 25 is preferably fully activated with first gas burner unit 21, as regulated by controller 62, during a pre-heating stage for oven cavity 5. After the preheating stage, electric heating element 25 is then operated on the on-off duty cycle discussed above whenever first gas burner unit 21 is on full. Cycling electric heating element 25 in this fashion has been found to enhance not only the overall cooking of the food items, but also advantageously performs a browning function.

During a broiling operation in a conventional gas oven, it is not uncommon to generate certain hot and relatively cold spots. The inclusion of electric resistance heating element 25 has been not only found to increase the broiling area within oven cavity 5, but also creates a substantially uniform temperature for the broiling operation. In one test conducted on this invention wherein a goal temperature of 170° F. was desired for oven cavity 5, the zones within oven cavity 5 which are maintained within 5° F. of the goal temperature was increased from 33% (no use of electric heating element 25) to 66% (combination of second gas burner unit 22 and electric heating element 25) during a broiling operation. Therefore, during a broiling operation, electric heating element 25 can be advantageously utilized to provide added heat and to balance hot and cold spots within oven cavity 5. Preferably, both electric heating element 25 and second burner unit 22 are operated in fully activated states during a broiling mode, with electric heating element 25 being de-activated in unison with second burner unit 22.

Electric heating element 25 can also be utilized during a self-cleaning mode of operation for oven 2. Although electric heating element 25 could simply not be used during self-cleaning such that oven 2 could be self-cleaned in a manner found in many gas cooking appliances, it is preferable to utilize electric heating element 25 initially to pre-heat oven cavity 5 at a controlled rate, either with or without second burner unit 22, prior to the operation of first burner unit 21. That is, if operated simultaneously, first and second gas burner units 21 and 22 would raise the temperature of oven cavity 5 at a fairly rapid rate which could have the tendency to develop rather strong odors as grease and other items are burned during the cleaning process. Operating electric heating element 25 at a controlled rate, either with or without second burner unit 22, to pre-heat oven cavity 5 prior to the operation of first gas burner unit 21 can advantageously minimize the amount of smoke and odors generated during this initial phase of the cleaning process wherein grease and the like are baked off the walls 8–12 of oven cavity 5. Once first gas burner unit 21 is fully activated to perform a pyrolysis operation, it is preferred that electric heating element 25 be simply de-activated, along with the second burner unit 22.

Based on the above, it should be readily apparent that electric heating element 25 is mounted in an advantageous manner relative to second burner unit 22 and is controlled in such a way to produce synergistic results with at least one of the first and second burner units 21 and 22 during baking, broiling and/or cleaning modes so as to enhance the overall performance of oven 2. Although described with respect to a preferred embodiment of the invention, it should be readily understood that various changes and/or modifications can be made to the invention without departing from the spirit thereof. In general, the invention is only intended to limited by the scope of the following claims.

We claim:

1. A cooking appliance including an oven cavity defined by top, bottom, rear and side wall portions, and having an open frontal portion adapted to be selectively closed by a pivotally mounted door comprising:

a lower gas burner unit positioned at the bottom wall portion of the oven cavity;

an upper gas burner unit positioned at the top wall portion;

an electric heating element mounted adjacent the top wall portion; and a control system for regulating the operation of each of the lower gas burner unit, the upper gas burner unit and the electric heating element, with operation of the electric heating element being dependent upon the operation of at least one of the lower and upper gas burner units.

2. The cooking appliance according to claim 1, wherein said upper gas burner unit extends in a generally horizontal plane which is spaced below the top wall portion of the oven cavity, said upper gas burner unit including a plurality of gas emitting ports, said electric heating element being mounted within the oven cavity at a position no closer to the top wall portion than the ports of the upper gas burner unit.

3. The cooking appliance according to claim 1, wherein the electric heating element is generally U-shaped.

4. The cooking appliance according to claim 1, wherein the control system operates in at least bake and broil modes wherein, in the baking mode, said control system cycles the electric heating element on and off while operating said lower gas burner unit at a full operating state.

5. The cooking appliance according to claim 4, wherein said control system cycles the electric heating element on and off at less than full capacity during the baking mode.

6. The cooking appliance according to claim 5, wherein an associated off-cycle period for the electric heating element is multiple times greater than an on-time period.

7. The cooking appliance according to claim 5, wherein said control system deactivates the electric heating element when the lower gas burner is cycled off.

8. The cooking appliance in accordance with claim 4, wherein, in the broil mode, both the electric heating element and the upper gas burner unit are operated.

9. The cooking appliance according to claim 1, wherein the control system operates in at least bake and broil modes wherein, in the broil mode, both the electric heating element and the upper gas burner unit are operated.

10. The cooking appliance according to claim 1, wherein the control system further operates in a cleaning mode in which the electric heating element is initially operated to preheat the oven cavity at a controlled rate prior to operation of the lower burner unit.

11. A method of operating a cooking appliance having upper and lower gas burner units mounted within an oven cavity, along with an electric heating element mounted adjacent the upper gas burner unit, comprising:

receiving operator input signals concerning a desired one of baking and broiling modes of operation;

controlling the operation of at least one of the lower and upper gas burner units; and regulating the operation of the electric heating element in dependence upon the operation of the at least one of the lower and upper gas burner units.

12. The method according to claim 11, further comprising: operating the cooking appliance in a baking mode wherein the electric heating element is cycled on and off while the lower gas burner unit is placed in a full operating state.

13. The method according to claim 12, further comprising: cycling the electric heating element on and off at less than full capacity during the baking mode.

14. The method according to claim 13, further comprising: cycling the electric heating element off for a time period which is multiple times greater than an on-time period during the baking mode.

15. The method according to claim 13, further comprising:

de-activating the electric heating element when the lower gas burner is cycled off.

16. The method according to claim 11, further comprising: operating both the electric heating element and the upper gas burner unit in full operating states during a broiling mode of operation.

17. The method according to claim 11, further comprising: operating the cooking appliance in a cleaning mode by initially activating the electric heating element to preheat the oven cavity at a controlled rate prior to operation of the lower burner unit.

* * * * *